US008454118B2

(12) United States Patent
Kida et al.

(10) Patent No.: US 8,454,118 B2
(45) Date of Patent: Jun. 4, 2013

(54) RECORDING APPARATUS

(75) Inventors: Akira Kida, Yokohama (JP); Masahiro Sugimoto, Yokohama (JP); Yuji Kanome, Yokohama (JP); Hiroyuki Tanaka, Kawasaki (JP); Yoshiaki Suzuki, Nagareyama (JP); Seiji Suzuki, Ebina (JP); Takeaki Nakano, Inagi (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 368 days.

(21) Appl. No.: 12/896,721

(22) Filed: Oct. 1, 2010

(65) Prior Publication Data

US 2011/0109690 A1 May 12, 2011

(30) Foreign Application Priority Data

Nov. 6, 2009 (JP) ..... 2009-255228

(51) Int. Cl.
*B41J 2/165* (2006.01)

(52) U.S. Cl.
USPC ..... 347/22

(58) Field of Classification Search
None
See application file for complete search history.

(56) References Cited

U.S. PATENT DOCUMENTS

2008/0246822 A1* 10/2008 Hara ..... 347/84
2010/0141725 A1* 6/2010 Shiohara ..... 347/102

FOREIGN PATENT DOCUMENTS

JP 2006-44021 A 1/2006

* cited by examiner

*Primary Examiner* — Matthew Luu
*Assistant Examiner* — Justin Seo
(74) *Attorney, Agent, or Firm* — Canon U.S.A., Inc. IP Division

(57) ABSTRACT

A supply unit is provided to supply humidified gas near a nozzle array of a line-type recording head. The flow-rate distribution of the supplied humidified gas in a direction of the nozzle array is changeable in accordance with a conveying region where a sheet is conveyed while opposing the nozzle array.

20 Claims, 9 Drawing Sheets

RECORDING APPARATUS

BACKGROUND OF THE INVENTION

1. Field of the Invention

The present invention relates to an inkjet recording apparatus using a line-type recording head.

2. Description of the Related Art

A line-type inkjet recording apparatus uses a line-type recording head in which a nozzle array extends over the entire width of a recording region. In a nozzle that is not frequently used in the nozzle array, a volatile component of ink evaporates, and this increases the ink viscosity. If the increase in ink viscosity further continues, there may be a risk that the nozzle cannot discharge ink (clogging).

To overcome this problem, attempts have been made to suppress evaporation of the volatile component of ink by supplying humidified gas near the nozzles in the recording head for the purpose of moisture retention. For example, Japanese Patent Laid-Open No. 2006-44021 (Patent Document 1) discloses a recording apparatus having a structure for supplying humidified gas into a gap between a recording head and a sheet.

A line-type recording apparatus has two different regions, that is, a region where a conveyed sheet faces a nozzle array of a recording head (hereinafter referred to as a conveying region) and a region where a conveyed sheet does not face the nozzle array (hereinafter referred to as a non-conveying region). Since sheets of various sizes (widths) are used in the recording apparatus, the relationship and ratio between the conveying region and the non-conveying region change in accordance with the size of the sheet to be used.

The gap through which humidified gas flows is narrower in the conveying region by an amount corresponding to the thickness of the sheet than in the non-conveying region. For this reason, the flow rate of humidified gas is lower in the conveying region than in the non-conveying region, and the effect of suppressing evaporation of ink in the nozzles is also smaller in the conveying region than in the non-conveying region. In addition, when a highly hygroscopic sheet, such as a paper sheet, is used, the sheet itself absorbs moisture from the humidified gas during conveyance. Hence, the effect of suppressing ink evaporation in the conveying region further decreases.

Ink does not evaporate from the nozzles that are included in the conveying region and are used for image recording. However, depending on an image to be formed, in the conveying region, there may be a nozzle whose use frequency is extremely low. Such a nozzle in the conveying region whose use frequency is extremely low may be clogged by ink evaporation. Patent Document 1 described above does not take this problem into consideration.

SUMMARY OF THE INVENTION

An apparatus according to an aspect of the present invention includes a conveying mechanism configured to convey a sheet in a first direction; a recording head having a nozzle array extending in a second direction intersecting the first direction, the recording head opposing the conveyed sheet with a gap being disposed therebetween; and a supply unit configured to supply humidified gas near the nozzle array. The supply unit changes a flow-rate distribution in the second direction of the supplied humidified gas in accordance with a conveying region where the sheet is conveyed while opposing the nozzle array.

Further features of the present invention will become apparent from the following description of exemplary embodiments with reference to the attached drawings.

DESCRIPTION OF THE EMBODIMENTS

Figure 1:
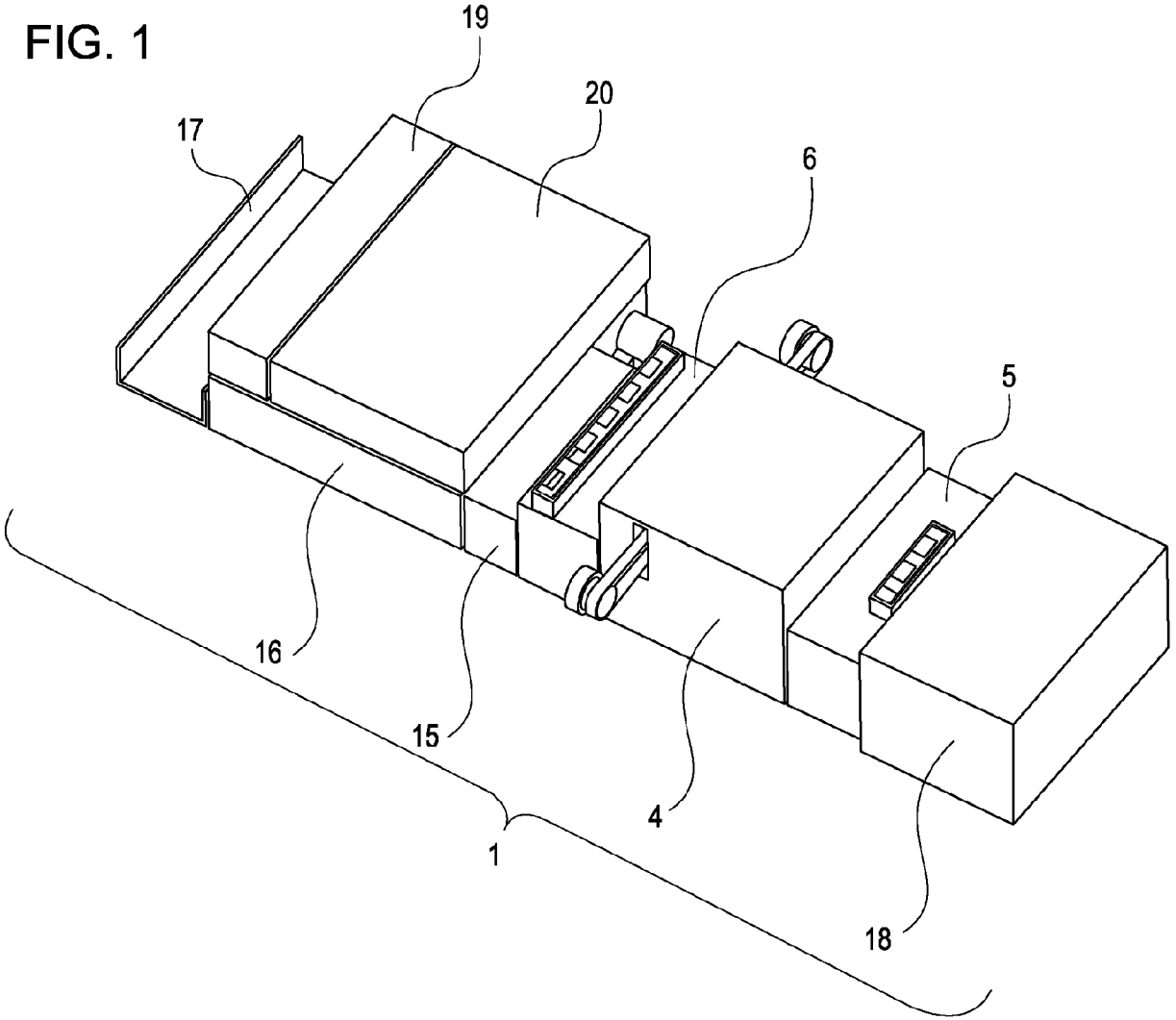
FIG. 1 is an overall perspective view of a recording apparatus according to a first embodiment.

FIG. 1 is a perspective view illustrating an overall configuration of a recording apparatus 1 according to a first embodiment of the present invention. Referring to FIG. 1, the recording apparatus 1 includes a paper feed unit 18, a supply unit 5, a recording unit 4, a recovery unit 6, a cutter unit 15, a dry unit 16, an ink tank unit 20, a control unit 19, and an output unit 17, which are arranged in order from an upstream side to a downstream side in a conveying direction of a sheet during recording.

Figure 2:
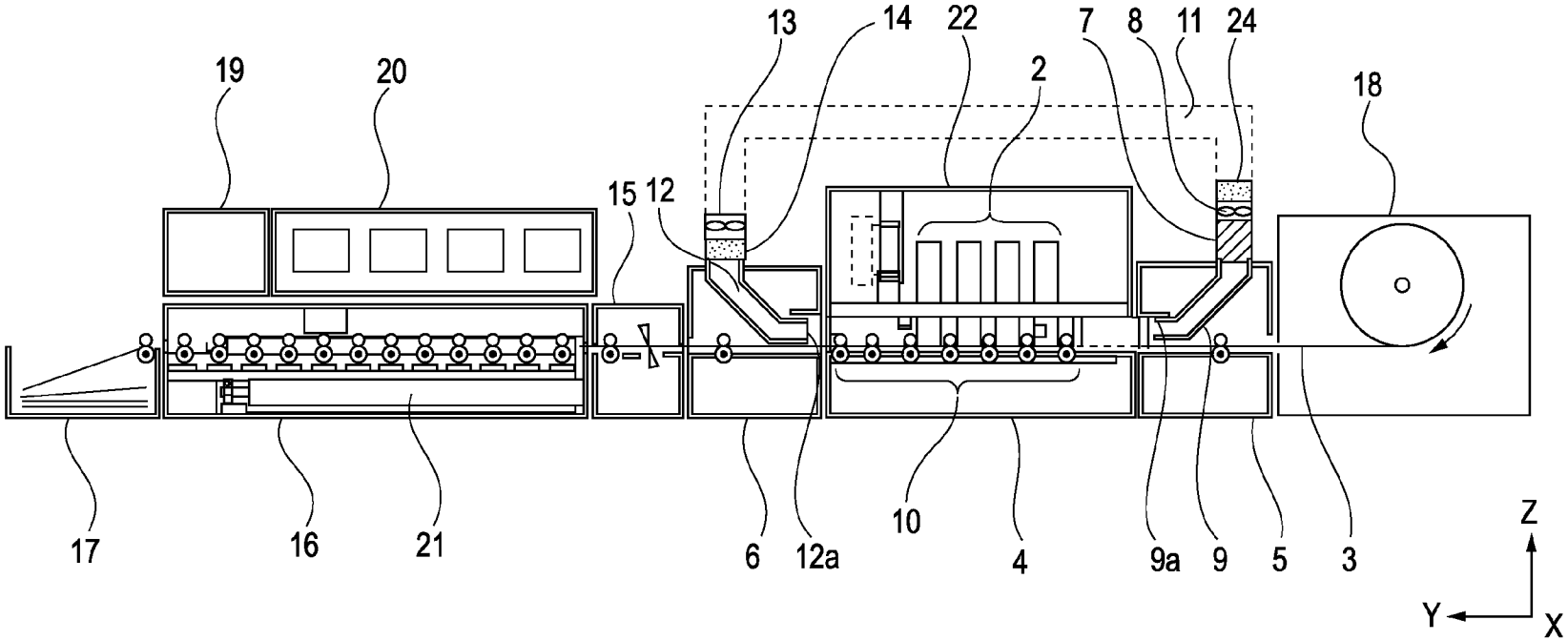
FIG. 2 is a cross-sectional view illustrating the internal configuration of the recording apparatus.

FIG. 2 is a cross-sectional view illustrating an internal configuration of the recording apparatus 1 of FIG. 1. The paper feed unit 18 rotatably holds a rolled sheet 3 serving as a recording medium. While the sheet 3 is a continuous sheet in the first embodiment, a cut sheet may be used alternatively. The paper feed unit 18 has a feeding mechanism that pulls out and supplies the sheet 3 downstream in a sheet conveying direction (a Y-direction, a first direction).

The recording unit 4 includes a plurality of recording heads 2 corresponding to different ink colors. While four recording heads are provided in correspondence to four colors C, M, Y, and K in the first embodiment, the number of colors is not limited to four. Inks of the different colors are supplied from the ink tank unit 20 to the corresponding recording heads 2 through ink tubes. The recording heads 2 are formed by line-type recording heads including nozzle arrays. The nozzle arrays use an inkjet method, and are provided in a region that covers the largest possible width of sheets to be used. The nozzle arrays extend in a direction (an X-direction, a second direction) intersecting the first direction (at right angles in the embodiment). In the nozzle arrays, nozzle chips serving as units may be arranged in a regular arrangement form, such as a staggered manner, over the entire width, or may be arranged in a line over the entire width. The inkjet method can use, for example, heating elements, piezoelectric elements, electrostatic elements, or MEMS elements.

In the recording unit 4, a sheet conveying path extends opposed to the recording heads 2, and a conveying mechanism 10 is provided to convey the sheet 3 along the sheet conveying path. The conveying mechanism 10 includes a plurality of conveying rollers arranged along the sheet conveying path and a platen having a support surface on which the sheet 3 is supported between the adjacent conveying rollers. The recording heads 2, the conveying mechanism 10, and the platen are stored in a housing 22. As described above, there are two different regions, that is, a region where the conveyed sheet 3 faces the nozzle arrays of the recording heads (conveying region) and a region where the conveyed sheet 3 does not face the nozzle arrays (non-conveying region). The relationship and ratio between the conveying region and the non-conveying region change in accordance with the size of the sheet to be used.

Humidified gas generated by the supply unit 5 is supplied into the recording unit 4. Although air is used as the gas in the first embodiment, other gases can be used instead. The humidified gas supplied to the recording unit 4 is recovered by the recovery unit 6. At least part of the humidified gas recovered by the recovery unit 6 is returned to the supply unit 5 for reuse through a return duct 11. In the recording unit 4, a humidity sensor 23 for measuring the gas humidity is provided near the nozzle arrays of the recording heads 2.

The supply unit 5 generates humidified gas and supplies the generated humidified gas near the nozzle arrays of the recording head 2. The supply unit 5 mainly includes a supply duct 9, a humidifying portion 7, a fan 8, and a filter 24. Some of the conveying rollers in the conveying mechanism 10 are provided below the supply duct 9, and the sheet conveying path passes between the conveying rollers. An end of the supply duct 9 serves as a supply port 9*a* from which humidified gas is ejected. The supply port 9*a* is oriented so as to eject the humidified gas into a gap between the recording heads 2 in the recording unit 4 and the sheet 3 or the support surface of the platen facing the recording heads 2 from the upstream side to the downstream side in the conveying direction. The supplied humidified gas mainly flows through the gap in the sheet conveying direction. As will be described below, the supply unit 5 can change the flow-rate distribution of the supplied humidified gas in the second direction.

Figure 3:
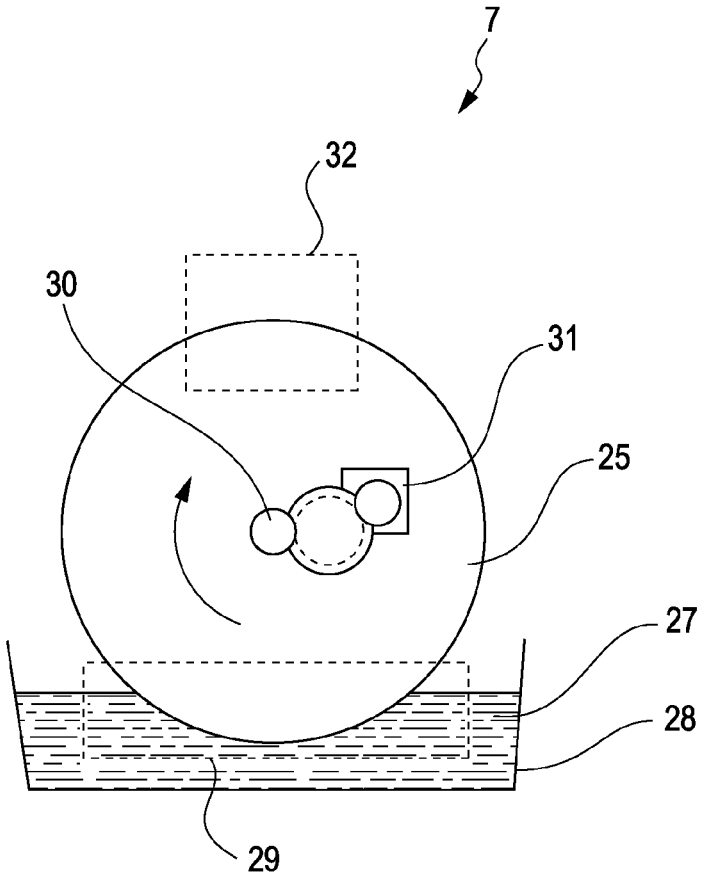
FIG. 3 is a schematic view of a humidifying portion.

The humidifying portion 7 generates humidified gas by vaporization. FIG. 3 is a schematic view illustrating the structure of the humidifying portion 7. The humidifying portion 7 includes a disk 25 which is formed by a highly absorbent member or to which a highly absorbent member is attached. The disk 25 is rotated on a shaft 30 by a driving mechanism 31. At a position 29, a lower portion of the disk 25 is in contact with water 27 stored in a tank 28. With rotation of the disk 25, the entire absorbent member gradually absorbs the water 27. Clean gas from which dust and foreign substances are removed by the filter 24 in the supply unit 5 is introduced into the humidifying portion 7 by the fan 8. The introduced gas passes while touching a part of the rotating disk 25 at a position 32. Hence, part of water in the absorbent member is converted into gas, thereby generating humidified gas. The humidifying ability of the humidifying portion 7 can be adjusted by the rotation speeds of the disk 25 and the fan 8. The control unit 19 performs feedback control on the basis of the detection result of the humidity sensor 23 so as to generate humidified gas having an appropriate humidity.

The humidifying portion 7 is not limited to the one of the first embodiment, and may be other known types such as an evaporative type, a water spray type, and a steam type. The evaporative type includes a moisture permeable membrane type, a drip flow-through type, and a capillary type in addition to the rotary type adopted in the first embodiment. The water spray type includes an ultrasonic type, a centrifugal type, a high-pressure spray type, and a dual-fluid spray type. The steam type includes a steam pipe type, a thermoelectric type, and an electrode type.

The humidified gas generated by the humidifying portion 7 is ejected as an airflow from the supply port 9*a* through the supply duct 9. The ejected humidified gas is supplied to a position near a nozzle surface of the most upstream recording head of a plurality of recording heads 2. The supplied humidified gas mainly flows from the upstream side to the downstream side in the first direction and passes through the gaps between the nozzle arrays of the recording heads and the sheet 3 or the platen surface in order. In other words, the humidified gas is supplied from the upstream side in the conveying direction, and flows to the downstream side in the conveying direction through the gaps between the nozzle arrays of the recording heads and the sheet. Since the tips of the nozzles are moisturized by the humidified gas, evaporation and drying of the ink in the nozzles are suppressed.

The recovery unit 6 recovers the humidified gas supplied to the recording unit 4. The recovery unit 6 mainly includes a recovery duct 12, a fan 13, and a filter 14. Some of the conveying rollers in the conveying mechanism 10 are provided below the recovery duct 12, and the sheet conveying path passes between the conveying rollers. An end of the recovery duct 12 serves as a recovery port 12*a* from which the humidified gas is sucked. The recovery port 12*a* is provided at a position such as to suck the humidified gas that has flown between the recording heads 12 and the opposing sheet 3 or platen support surface and passed by the most downstream recording head 2.

Rotation of the fan 13 produces a sucking force for generating an airflow in the recovery duct 12. The filter 14 mainly removes ink mist. The recovery duct 12 is connected to the return duct 11 via the fan 13, and the return duct 11 is connected to the humidifying portion 7 and the supply duct 9 via the filter 24. That is, the humidified gas recovered from the recording unit 4 is returned to the supply unit 5 for reuse through a return passage formed by the return duct 11. Since the gas introduced in the humidifying portion 7 for reuse originally has a relatively high humidity, the total humidification efficiency of the apparatus is enhanced. Alternatively, part of the humidified gas recovered from the recovery duct 12 may be returned for reuse, and the other part may be discharged into the interior of the recording apparatus 1. If the humidity of the humidified gas has decreased to a value equivalent to the humidity in the recording apparatus 1 when the humidified gas is recovered by the recovery duct 12, a great enhancement of humidification efficiency cannot be expected. Hence, the return duct 11 used to reuse the humidified gas may be omitted.

The cutter unit 15 includes a cutter mechanism, and cuts the continuous sheet to a predetermined size after recording is performed on the continuous sheet by the recording unit 4. The dry unit 16 dries the ink on cut sheets in a short time, and includes a heater 21 and a plurality of conveying rollers arranged along the conveying path. The output unit 17 receives cut sheets output from the dry unit 16, and a plurality of sheets are stacked in the output unit 17. The control unit 19 is a controller that performs various control operations over the entire recording apparatus 1 and controls driving, and includes a CPU, a memory, and various I/O interfaces.

Figure 4:
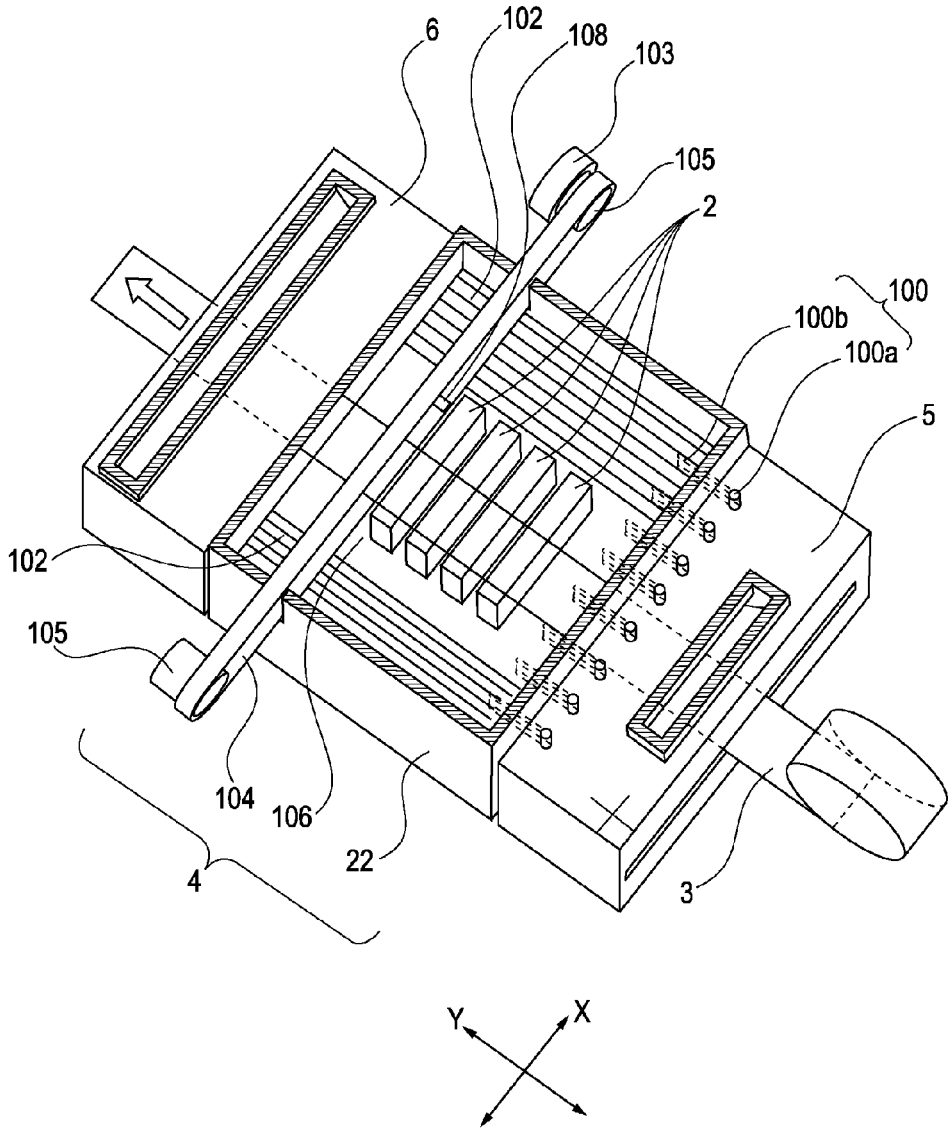
FIG. 4 is a perspective view illustrating structures of a recording unit, a supply unit, and a recovery unit.
Figure 5:
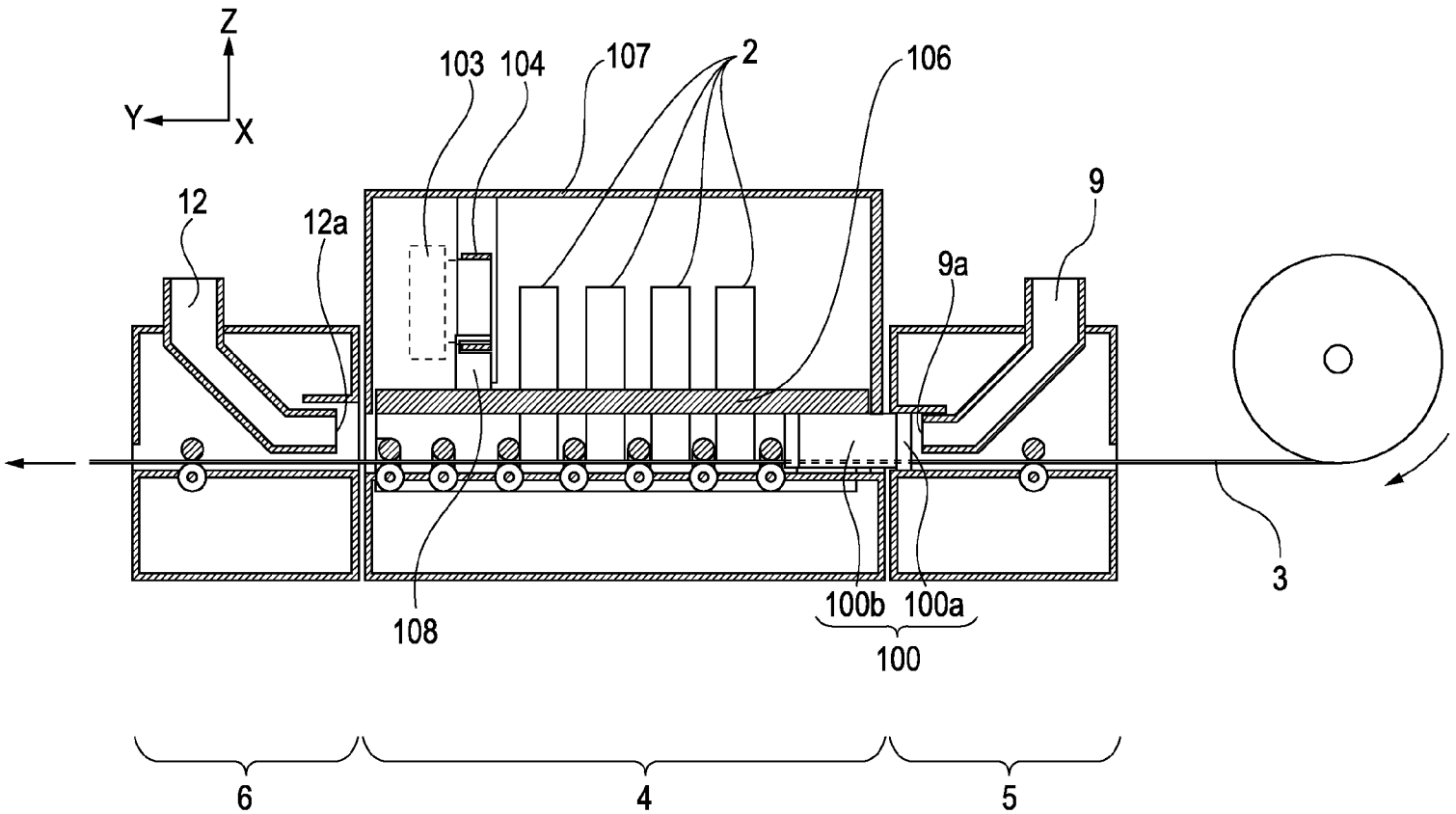
FIG. 5 is a sectional view of the recording unit, the supply unit, and the recovery unit illustrated in FIG. 4.

FIG. 4 is a perspective view illustrating detailed structures of the recording unit 4, the supply unit 5, and the recovery unit 6 in the recording apparatus 1. FIG. 5 is a sectional view of the same structures, as viewed in the second direction. Referring to FIGS. 4 and 5, in the housing 22 of the recording unit 4, an enclosed space that is enclosed, except for an entrance port and an exit port of the sheet conveying path, is provided. A plurality of recording heads 2 are held together by a holder 106 in the enclosed space of the housing 22.

To reduce the unevenness in use frequency of the nozzle arrays of the recording heads 2, the holder 106 is movable in the second direction or an angular direction close to the second direction. For that purpose, the holder 106 is provided with a displacement mechanism (first displacement mechanism) including a pulse motor 103, a belt 104, and pulleys 105. The holder 106 is fixed to the belt 104 at an attachment portion 108. The pulse motor 103 drives the pulleys 105 attached to the belt 104. To reduce the unevenness in use frequency of the nozzles, the control unit 19 periodically changes the nozzles to be used for the sheet by driving the pulse motor 103 to move the recording heads 2, on the basis of the accumulated number of discharging operations or accumulated use time of the nozzles in the nozzle arrays. The holder 106 can also be displaced by another displacement mechanism (second displacement mechanism) in the up-down direction (Z-direction, third direction) in which the recording heads 2 face the sheet 3. When the holder 106 is displaced in the third direction, the recording heads 2 move to different height positions during recording operation and during maintenance operation (e.g., preliminary discharging, wiping of the nozzles, and capping for suppression of dry of the nozzles).

Sealing covers 102 formed of a flexible material are provided between both side faces of the holder 106 and two inner side faces of the housing 22. The sealing covers 102 further form, in the housing 22, a chamber structure having a chamber space. The chamber structure includes parts of the recording heads 2 including at least the nozzle arrays and at least part of the conveying mechanism 10 facing the nozzle arrays. The sealing covers 102 are also formed of a moisture-proof material that does not let water through. For example, the sealing covers 102 have a bellows-shaped structure such as to flexibly deform in the second direction and the third direction, and can deform to follow the displacement of the holder 106 in the second direction and the third direction. That is, with the displacement of the recording heads 2, part of the chamber structure deforms while maintaining airtightness. Although the chamber space in the chamber structure is not completely airtight in the first direction because of the presence of openings, it is kept substantially airtight to an extent such that the humidity does not greatly change in a short time.

A flow adjusting mechanism 100 can change a flow-rate distribution in the second direction of humidified gas supplied near the nozzle array of the most upstream recording head 2. The flow adjusting mechanism 100 sets the flow-rate distribution so that a larger amount of humidified gas is supplied to the conveying region where the sheet is conveyed. The flow adjusting mechanism 100 has a movable louver structure including a plurality of (eight in the embodiment) flappers whose angles can be changed singly or in pairs. The flappers are arranged in the second direction near the supply port 9*a* of the supply duct 9 in a space between the holder 106 and the platen in a manner such as not to touch the conveyed sheet 3. Humidified gas ejected from the supply port 9*a* passes between the flappers and is then introduced into the recording unit 4.

Figure 6:
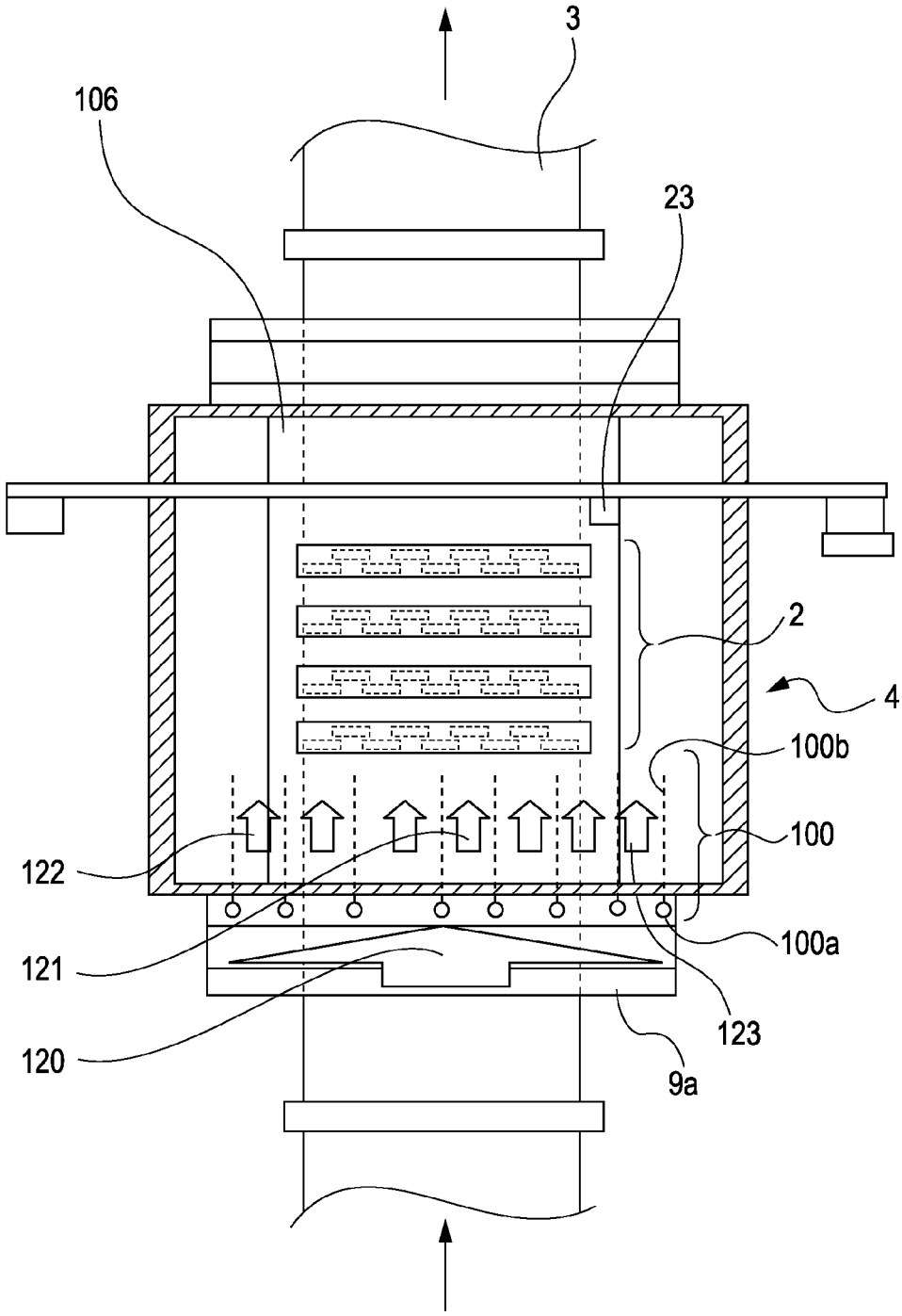
FIG. 6 illustrates a structure and an operating state of a flow adjusting mechanism.
Figure 7:
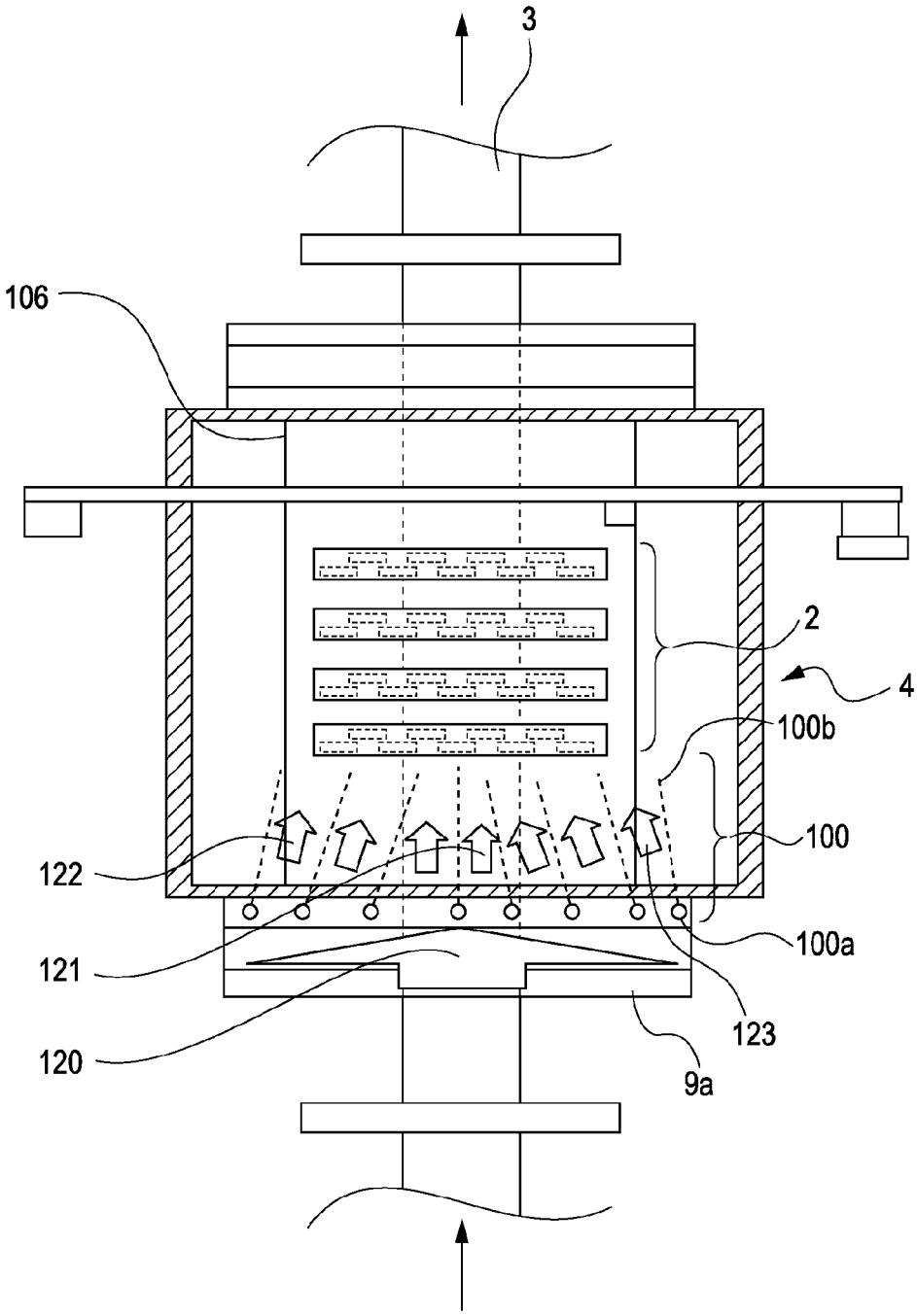
FIG. 7 illustrates a structure and an operating state of the flow adjusting mechanism.

FIGS. 6 and 7 illustrate a structure and an operating state of the flow adjusting mechanism 100. In each of the flappers, a blade 100*b* shaped like a flat plate is connected to a support shaft 100*a*, and the blade 100*b* can turn on the support shaft 100*a*. While the blade 100*b* is formed of stainless steel in the first embodiment, it may be formed of any other material as long as the material does not cause property change due to humidification and has a sufficient rigidity to withstand air pressure. The support shaft 100*a* is attached to a housing of the supply unit 5. Part of the blade 100*b* is located in the supply unit 5, and the other part is located in the recording unit 4. Actuators, such as motors or shape-memory actuators, are connected to the respective support shafts 100*a* of the flappers so that the support shafts 100*a* can be individually turned according to a command from the control unit 19. With turn of the support shafts 100*a*, the blades 100*b* turn to change the orientations thereof.

In FIG. 6, the blades 100*b* of all flappers point in the same direction (first direction). This setting is made when the width of the sheet 3 to be used is large. A flow 120 of humidified gas introduced from the supply port 9*a* is divided by a plurality of flappers in the flow adjusting mechanism 100. Since all of the flappers point in the same direction (first direction), all flows from the center flow 121 to end flows 122 and 123 are ejected in the same direction. For this reason, the flow-rate distribution in the second direction of the humidified gas supplied from the flow adjusting mechanism 100 is rarely different between the center portion and the end portions, and the distribution is substantially uniform. As a result, the humidified gas is properly supplied to the entire nozzle arrays, and ink evaporation is suppressed. Since the sheet used in the embodiment uses the entire nozzle regions of the line-type recording heads 2, the conveying region extends over the entire area where the nozzle arrays are provided. Although a nozzle whose use frequency is extremely low may be in the conveying region, depending on an image to be recorded, humidified gas is supplied to such a nozzle during image formation for proper moisture retention. This suppresses evaporation and drying of the ink in the nozzle.

FIG. 7 illustrates a state of the flow adjusting mechanism 100 when the width of the used sheet 3 is small. A center region corresponding to about one third of the nozzle arrays serves as a conveying region where the sheet passes, and a region provided on each side of the center region and corresponding to about one third of the nozzle arrays serves as a non-conveying region. As compared to the state illustrated in FIG. 6, the angles of the flappers in the flow adjusting mechanism 100 are different. The flappers are oriented to point in symmetrically inward directions. Airflows from three portions, that is, a center flow 121 and flows on the right and left sides of the center flow 121, are mainly supplied to the conveying region, and flows from two outer positions on each outer side of the above three portions are mainly supplied to the non-conveying region. Thus, in the flow-rate distribution in the second direction of the humidified gas supplied near the nozzle arrays, the flow rate of humidified gas is higher near the center portion where the sheet 3 is located than in the peripheral portions.

As described above, the gap through which the humidified gas flows is narrower in the conveying region by the amount corresponding to the thickness of the sheet 3 than in the non-conveying region, and therefore, the humidified gas flows less smoothly. Further, a local decrease in humidity is caused in the conveying region by moisture absorption of the sheet 3 itself. When the flow rate of humidified gas introduced to the recording heads 2 is higher in the conveying region, the humidified gas is properly supplied to the nozzle included in the conveying region, whose use frequency is low, and the nozzle is moisturized properly. Hence, evaporation of ink in the nozzle whose use frequency is low is suppressed. Moreover, since the humidified gas is also properly supplied to the unused nozzles in the non-conveying region, the nozzles are moisturized, and evaporation of ink in the nozzles is suppressed. As a result, it is possible to properly supply humidified gas to the entire nozzle arrays, regardless of the conveying region of the sheet, and this suppresses evaporation and drying of ink.

Even when the width of the used sheet does not change, the conveying region where the sheet passes along the nozzle arrays is sometimes changed to reduce the unevenness in use efficiency of the nozzles. In this case, a larger amount of humidified gas can be supplied to the conveying region by individually setting the orientations of the flappers in the flow adjusting mechanism 100 in correspondence to the conveying region.

As described above, according to the first embodiment, the conveying region for the nozzle arrays changes according to the width or position of the used sheet. By changing the state of the flow adjusting mechanism 100 in correspondence to the change of the conveying region, the flow-rate distribution in the second direction of humidified gas supplied near the most upstream nozzle array is set. Thus, in all recording heads, humidified gas is properly supplied to the entire nozzle array and ink evaporation can be suppressed.

Figure 8:
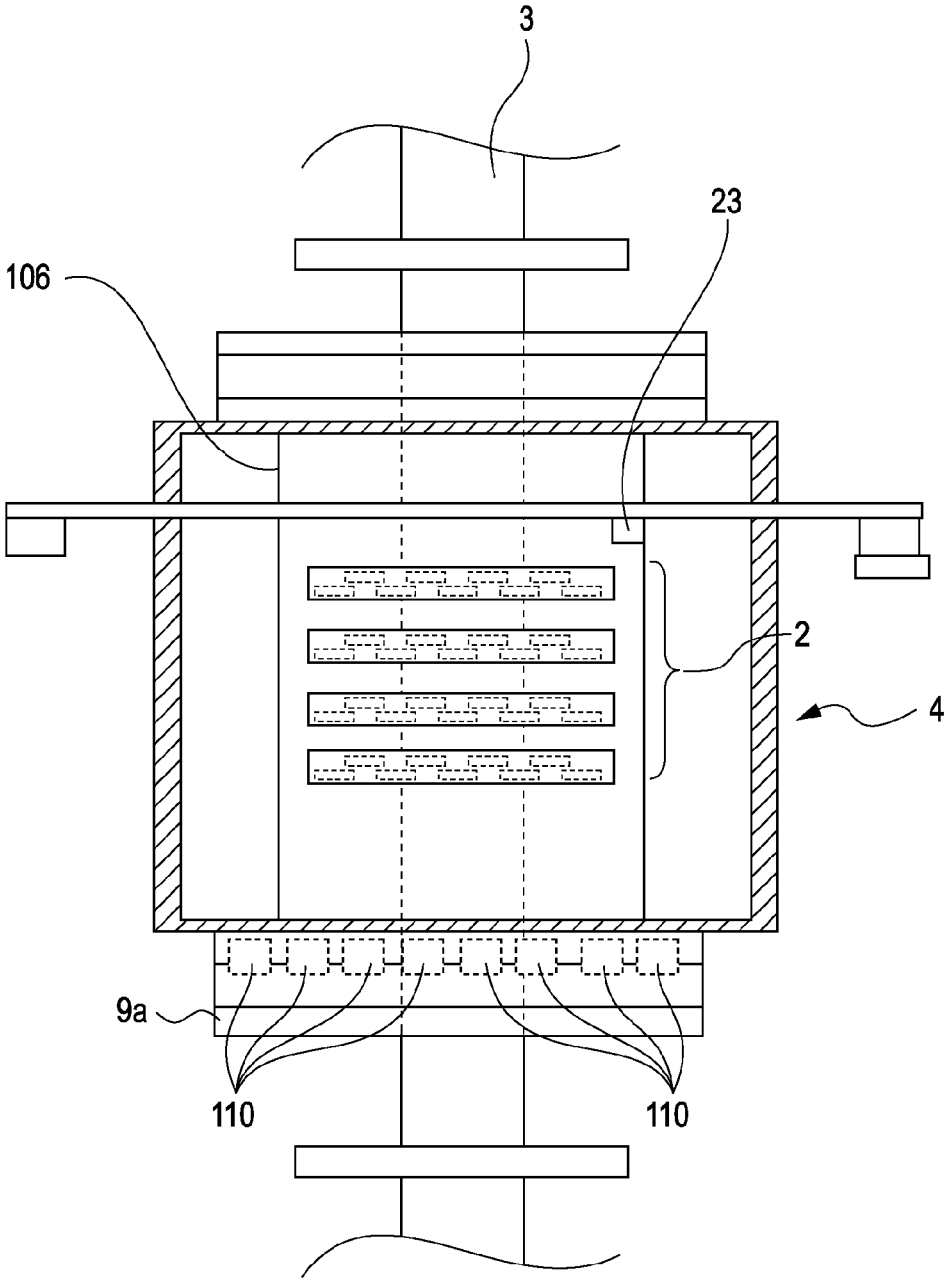
FIG. 8 illustrates a structure and an operating state of a flow adjusting mechanism according to second and third embodiments.
Figure 9:
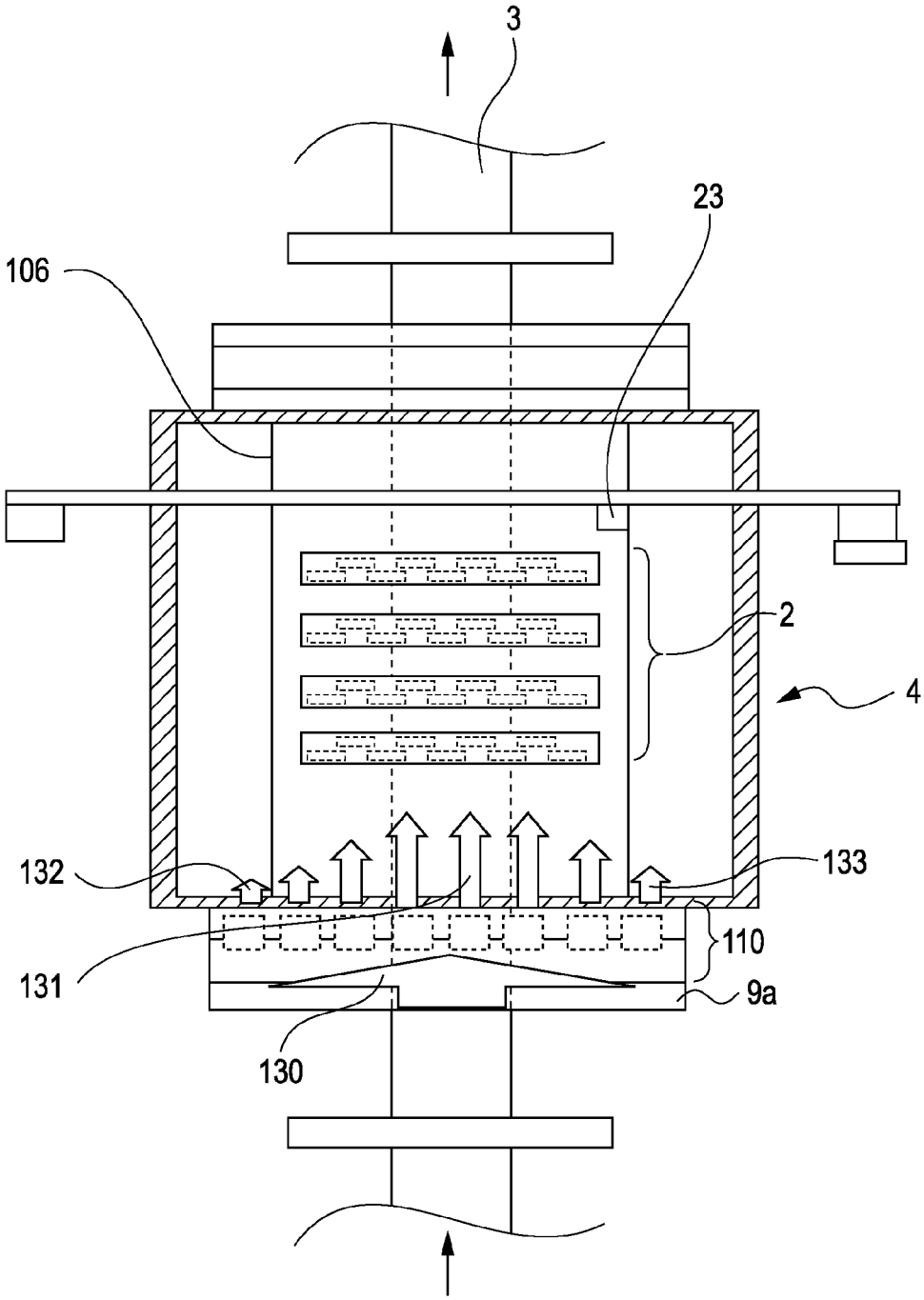
FIG. 9 illustrates a structure and an operating state of a flow adjusting mechanism.

A second embodiment of the present invention will be described. FIGS. 8 and 9 illustrate a structure and an operating state of a flow adjusting mechanism 110 in the second embodiment.

In the second embodiment, the flow adjusting mechanism 110 includes a plurality of throttle valves arranged in a second direction at a supply port 9*a* of a supply duct 9, instead of the louver mechanism adopted in the first embodiment. The aperture areas of the throttle valves can be individually and non-uniformly changed according to a command from a control unit 19. As the aperture area of a throttle valve increases, the amount of humidified gas to be ejected from the throttle valve increases. Therefore, by individually setting the aperture states of the throttle valves, the flow-rate distribution in the second direction of the humidified gas supplied near a nozzle array of the most upstream recording head 2 can be changed. Thus, in all recording heads, humidified gas is properly supplied to the entire nozzle array, and this suppresses ink evaporation.

FIG. 8 illustrates a case in which a sheet 3 to be used is wide and the aperture areas of all throttle valves are equal. FIG. 9 illustrates a case in which the sheet 3 is narrow and the aperture area decreases from the center throttle valve, whose aperture area is the largest, toward the peripheral throttle valves. Flows from three portions, that is, a center flow 131 and flows on the right and left sides of the center flow 121, are mainly supplied to the conveying region at a high flow rate, and flows from portions on the outer sides of the above three portions are mainly supplied to the non-conveying region at a relatively low flow rate. The flow-rate distribution in the second direction of humidified gas introduced near the nozzle array of the most upstream recording head is such that the flow rate is higher than near the center portion where the sheet 3 is located than in the peripheral portions. Thus, in all recording heads, humidified gas is properly supplied to the entire nozzle array, and this suppresses ink evaporation.

A third embodiment of the present invention will be described also with reference to FIGS. 8 and 9. Instead of a plurality of throttle valves adopted in the second embodiment, a flow adjusting mechanism 110 of the third embodiment includes a plurality of fans. The fans are rotated by independent motors, and the rotation speeds of the motors are individually controlled and nonuniformly changed according to a command from a control unit 19. By individually setting the rotation speeds of the fans, the flow-rate distribution in the second direction of humidified gas supplied near a nozzle array of the most upstream recording head 2 can be changed. Thus, in all recording heads, humidified gas is properly supplied to the entire nozzle array and this suppresses ink evaporation. Since an airflow is generated at a supply duct 9 by the fans, the fan 8 provided upstream of the supply duct 9 may be omitted.

According to the above-described embodiments, the flow adjusting mechanism can change the flow-rate distribution in the second direction so that a larger amount of humidified gas is supplied to the conveying region where the sheet is conveyed while opposing the nozzle array. For this reason, humidified gas is properly supplied to the entire nozzle array, and this suppresses ink evaporation in the nozzles. Moreover, part of the nozzle array of the recording head is stored in the flexible chamber structure, necessary airtightness is maintained even when the recording head, and this enhances the use efficiency of humidified gas. In addition, since there is provided the return path through which the humidified gas supplied near the nozzle arrays is returned for reuse, the utilization efficiency of humidified gas is enhanced further.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-255228 filed Nov. 6, 2009, which is hereby incorporated by reference herein in its entirety.

What is claimed is:

1. An apparatus comprising:

a conveying mechanism configured to convey a sheet in a first direction;

a recording head having a nozzle array extending in a second direction intersecting the first direction, the recording head opposing the conveyed sheet with a gap being disposed therebetween; and a supply unit configured to supply humidified gas near the nozzle array, wherein the supply unit changes a flow-rate distribution in the second direction of the supplied humidified gas in accordance with a conveying region where the sheet is conveyed while opposing the nozzle array.

2. The apparatus according to claim 1, wherein the supply unit changes the flow-rate distribution so that an amount of the humidified gas is supplied toward the conveying region, and the supplied humidified gas flows through the gap in the first direction.

3. The apparatus according to claim 1, wherein the supply unit includes:

a humidifying portion configured to generate the humidified gas; and a duct configured to guide the generated humidified gas near the nozzle array.

4. The apparatus according to claim 1, wherein the supply unit includes a flow adjusting mechanism having a flapper, and changes a direction of a flow of the humidified gas by changing an orientation of the flapper.

5. The apparatus according to claim 1, wherein the supply unit includes a flow adjusting mechanism having a plurality of throttle valves arranged in the second direction, and changes aperture areas of the throttle valves.

6. The apparatus according to claim 1, wherein the supply unit includes a flow adjusting mechanism having a plurality of fans arranged in the second direction, and changes rotation speeds of the fans.

7. The apparatus according to claim 1, further comprising:

a mechanism configured to change a positional relationship in the second direction between the sheet and the nozzle array.

8. The apparatus according to claim 1, wherein a plurality of the recording heads are arranged in the first direction, and the humidified gas is supplied from an upstream side and flows to a downstream side through gaps between the nozzle arrays of the recording heads and the sheet.

9. The apparatus according to claim 1, further comprising:

a return path through which the humidified gas supplied near the nozzle array is returned to the supply unit for reuse.

10. The apparatus according to claim 1, further comprising:

a chamber structure configured to provide a space including the nozzle array and part of the conveying mechanism opposing the nozzle array.

11. The apparatus according to claim 10, further comprising:

a displacement mechanism configured to displace the recording head in the second direction, wherein part of the chamber structure deforms with displacement of the recording head in the second direction.

12. The apparatus according to claim 11, wherein the part of the chamber structure is a flexible member that is attached to a holder configured to hold and displace the recording head in the second direction and that deforms in correspondence to displacement of the holder.

13. A method comprising:

conveying a sheet in a first direction;

disposing a gap between a recording head and the conveyed sheet, the recording head having a nozzle array extending in a second direction intersecting the first direction; and supplying humidified gas near the nozzle array by a supply unit, wherein the supply unit changes a flow-rate distribution in the second direction of the supplied humidified gas in accordance with a conveying region where the sheet is conveyed while opposing the nozzle array.

14. The method according to claim 13, wherein the supply unit changes the flow-rate distribution so that an amount of the humidified gas is supplied toward the conveying region, and the supplied humidified gas flows through the gap in the first direction.

15. The method according to claim 13, further comprising:

generating the humidified gas by a humidifying portion of the supply unit; and guiding the generated humidified gas near the nozzle array.

16. The method according to claim 13, further comprising changing a direction of a flow of the humidified gas by changing an orientation of a flapper in a flow adjusting mechanism of the supply unit.

17. The method according to claim 13, further comprising changing aperture areas of a plurality of throttle valves arranged in the second direction in a flow adjusting mechanism of the supply unit.

18. The method according to claim 13, further comprising changing rotation speeds of a plurality of fans arranged in the second direction in a flow adjusting mechanism of the supply unit.

19. The method according to claim 13, further comprising changing a positional relationship in the second direction between the sheet and the nozzle array.

20. The method according to claim 13, further comprising:

arranging a plurality of the recording heads in the first direction; and supplying the humidified gas from an upstream side so that the humidified gas flows to a downstream side through gaps between the nozzle arrays of the recording heads and the sheet.

* * * * *